US007037250B2

(12) United States Patent
Albright

(10) Patent No.: US 7,037,250 B2
(45) Date of Patent: May 2, 2006

(54) METHOD OF FORMING A BURST-RESISTANT EASY-OPEN CORNER IN A HEAVY DUTY BAG

(75) Inventor: Timothy L. Albright, High Point, NC (US)

(73) Assignee: Exopack-Thomasville LLC, Thomasville, NC (US)

( * ) Notice: Subject to any disclaimer, the term of this patent is extended or adjusted under 35 U.S.C. 154(b) by 0 days.

(21) Appl. No.: 10/649,715

(22) Filed: Aug. 26, 2003

(65) Prior Publication Data

US 2004/0038792 A1 Feb. 26, 2004

Related U.S. Application Data

(63) Continuation of application No. 09/934,417, filed on Aug. 21, 2001, now Pat. No. 6,609,999.

(51) Int. Cl.
*B31B 1/90* (2006.01)

(52) U.S. Cl. ..... 493/212; 493/267; 493/227; 493/228; 493/229; 493/232; 53/133.6; 53/133.8; 53/412

(58) Field of Classification Search ..... 53/412, 53/133.6, 133.8; 493/267, 227, 228, 229, 493/232, 308, 212

See application file for complete search history.

(56) References Cited

U.S. PATENT DOCUMENTS

| | | | | |
|---|---|---|---|---|
| 3,397,835 | A * | 8/1968 | Henning | 383/208 |
| 4,644,732 | A * | 2/1987 | Morton | 53/412 |
| 4,768,411 | A * | 9/1988 | Su | 83/170 |
| 5,371,997 | A * | 12/1994 | Kopp et al. | 53/412 |
| 5,430,987 | A * | 7/1995 | Lane, Jr. et al. | 53/133.8 |
| 5,482,376 | A * | 1/1996 | Moseley et al. | 383/209 |
| 5,636,925 | A * | 6/1997 | Smiley | 383/6 |
| 5,702,339 | A * | 12/1997 | Smiley | 493/196 |
| 6,402,379 | B1 * | 6/2002 | Albright | 383/209 |

* cited by examiner

*Primary Examiner*—Louis K. Huynh
*Assistant Examiner*—Brian Nash
(74) *Attorney, Agent, or Firm*—Schwartz Law Firm P.C.

(57) ABSTRACT

A method of forming a perforated tear line in a bag to form an easy-open corner portion. The perforation blade includes a base formed to span the corner portion of the bag. The base has a first end adapted to extend to the end edge of the bag proximate a seal line, and a second end adapted to extend to one side edge of the bag. A series of closely spaced perforation teeth are formed with the base, and are adapted to penetrate the first and second walls of the bag to form a corresponding series of perforations at the corner portion of the bag. A starter tooth is formed at the first end of the base, and is adapted to cut a starter nick in a skirt of the bag between the end edge and the proximate seal line. A burst protection gap is formed between the starter tooth and a first of the series of perforation teeth. The burst protection gap is adapted for safely receiving the seal line of the bag to prevent severing the seal line when cutting the perforations.

6 Claims, 4 Drawing Sheets

METHOD OF FORMING A BURST-RESISTANT EASY-OPEN CORNER IN A HEAVY DUTY BAG

This application is a continuation of U.S. application Ser. No. 09/934,417 filed Aug. 21, 2001, now U.S. Pat. No. 6,609,999.

TECHNICAL FIELD AND BACKGROUND OF THE INVENTION

This invention relates generally to heavy duty plastic bags, and more specifically, to a perforation blade and method used to form an easy-open corner which resists inadvertent bursting during handling of a filled bag. Such bags are commonly used for heavy-duty applications, such as for transport, sale, and storage of materials such as chemicals, salt, fertilizer, lawn lime, potting soil, and the like. The are typically fabricated from LD, HD, or LLD polyolefin sheet or tube stock, such as polyethylene or polypropylene having a thickness in the range of 3 to 12 mils. The sheet or tube stock may be coextruded or monoextruded, and may be a single ply or multi-ply material. The multi-ply material may be multiple thicknesses of the same sheet or tube stock, or different materials to provide particular characteristics, such as strength, flexibility, UV resistance, or color. The sheet stock may also be woven or non-woven synthetic or non-synthetic material. While the invention has particular application to bags with a capacity of from 20 to 100 pounds, the present blade used to form the easy-open corner can be applied to bags of any size.

Conventional, heavy-duty bags of the prior art are typically cut along the top with a knife or other suitable tool to define a sufficiently large opening through which the contents of the bag are dispensed. In the absence of a cutting knife or tool, attempts to manually tear open the bag by hand are often futile, because of the relative thickness and durability of such bags. Once opened, the bag must generally be embraced with both arms, lifted and inverted to dispense the contents from an opening in or near the top of the bag. In many cases, this requires substantial physical effort, and sometimes results in inadvertent uncontrolled dumping or over-dumping of the contents.

In an effort to facilitate opening and control dumping, some heavy duty bags are formed with a perforated, removable corner adapted for being hand-torn to form a pourer. While such bags solve many problems of the prior art, certain disadvantages and limitations remain. Since the perforations formed at the corner of the bag typically pass entirely, or at least partially, through the end seal, the bag is prone to inadvertent rupture and spillage during transport and handling.

SUMMARY OF THE INVENTION

Therefore, it is an object of the present invention to provide a perforation blade used to form an improved easy-open corner of a heavy duty bag which resists inadvertent bursting during transport and handling of a filled bag.

It is another object of the invention to provide a bag cutting device which includes an improved perforation blade used to form an easy-open corner.

These and other objects of the present invention are achieved in the preferred embodiments disclosed below by providing a perforation blade used for cutting a perforated tear line in a bag to form an easy-open corner portion. The corner portion is removable to define a pourer through which contents of the bag are dispensed. The bag has first and second walls with joined opposing side edges, opposing end edges, and a seal line proximate one of the end edges for sealing closed an end of the bag. The perforation blade includes a base formed to span the corner portion of the bag. The base has a first end adapted to extend to the end edge of the bag proximate the seal line, and a second end adapted to extend to one side edge of the bag. A series of specifically spaced perforation teeth are formed with the base, and are adapted to penetrate the first and second walls of the bag to form a corresponding series of perforations at the corner portion of the bag. A starter tooth is formed at the first end of the base, and is adapted to cut a starter nick in a skirt of the bag between the end edge and the proximate seal line. A burst protection gap is formed between the starter tooth and a first of the series of perforation teeth. The burst protection gap is adapted for safely receiving the seal line of the bag to prevent severing the seal line when cutting the perforations.

According to another preferred embodiment of the invention, the burst protection gap is at least 50 percent wider than the space formed between the first perforation tooth and a second, adjacent perforation tooth.

According to another preferred embodiment of the invention, the burst protection gap defines a depth at least 20 percent greater than a depth of the space between the first perforation tooth and a second, adjacent perforation tooth.

According to another preferred embodiment of the invention, the starter tooth is larger than the first perforation tooth.

According to another preferred embodiment of the invention, the perforation teeth extend from the burst protection gap to the second end of the base.

According to another preferred embodiment of the invention, the perforation teeth are uniformly spaced to a specific gap dimension.

According to another preferred embodiment of the invention, the perforation teeth have a uniform length.

According to another preferred embodiment of the invention, the base defines a height greater than a length of the first perforation tooth.

According to another preferred embodiment of the invention, the base is formed of spring steel.

In another embodiment, the invention is a bag cutting device with a perforation blade used for cutting a perforated tear line in a bag to form an easy-open corner portion. The perforation blade includes a base formed to span the corner portion of the bag. The base has a first end adapted to extend to the end edge of the bag proximate a seal line, and a second end adapted to extend to one side edge of the bag. A series of closely spaced perforation teeth are formed with the base, and are adapted to penetrate the first and second walls of the bag to form a corresponding series of perforations at the corner portion of the bag. A starter tooth is formed at the first end of the base, and is adapted to cut a starter nick in a skirt of the bag between the end edge and the proximate seal line. A burst protection gap is formed between the starter tooth and a first of the series of perforation teeth. The burst protection gap is adapted for safely receiving the seal line of the bag to prevent severing the seal line when cutting the perforations.

In yet another embodiment, the invention is a method of forming an easy-open corner portion of a bag. The corner portion is removable to define a pourer through which contents of the bag are dispensed. The bag has first and second walls with joined opposing side edges, opposing end edges, and a seal line proximate one of the end edges for sealing closed an end of the bag. The method includes the steps of forming a starter nick in a skirt of the bag between the end edge and the proximate seal line. A series of closely spaced perforations are formed in the first and second walls of the bag. The perforations extend along a predefined tear line from the end edge of the bag proximate the starter nick to one side edge of the bag. When forming the starter nick and perforations, the seal line of the bag is bypassed to avoid severing the seal line during formation of the easy-open corner portion.

According to one preferred embodiment of the method, the easy-open corner portion of the bag is formed using a laser.

According to another preferred embodiment of the method, the easy-open corner portion of the bag is formed using a radiused wheel with outwardly projecting perforation teeth.

According to yet another preferred embodiment of the method, the easy-open corner portion of the bag is formed using an elongated perforation blade.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
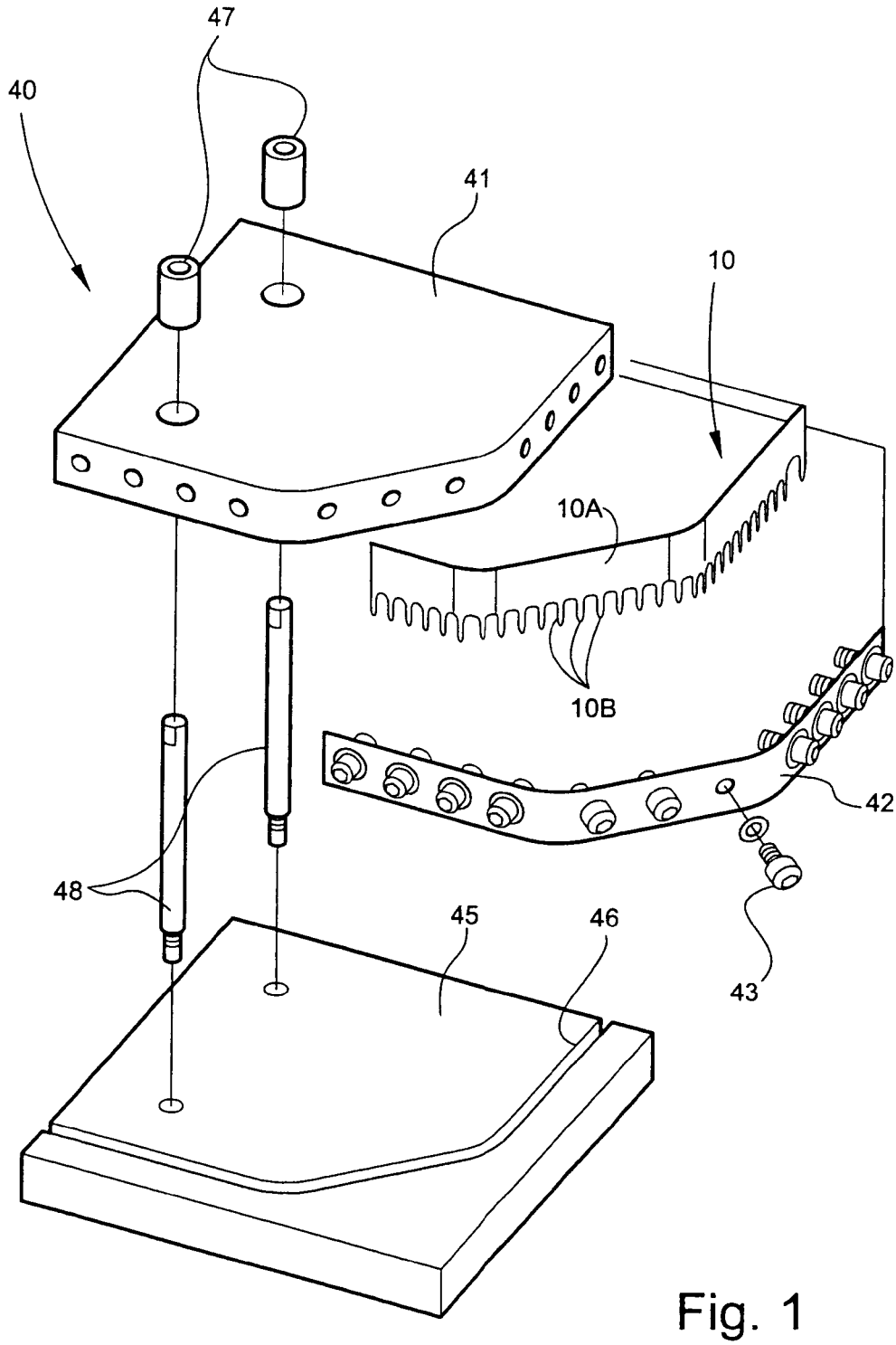
FIG. 1 is an environmental perspective view of a perforation blade according to one preferred embodiment of the invention, and showing the blade mounted within a bag cutting device used for cutting a perforated tear line in a bag.

Referring now specifically to the drawings, a perforation blade used to form a bag with an easy-open corner is illustrated in FIG. 1 and shown generally at reference numeral 10. Such bags are typically fabricated from polyolefin sheet or tube stock, and are commonly used for heavy-duty applications such as for transport, sale, and storage of materials such as chemicals, salt, fertilizer, lawn lime, potting soil, and the like. The bag 20, shown in FIG. 2, has first and second walls 21 and 22 with joined opposing side edges 23 and 24, opposing end edges 25 and 26, and a seal line 28 proximate the end edge 25 for sealing closed an end of the bag 20. The opposite end of the bag 20 remains open for filling. The term "joined" is used in a broad sense to mean either two formerly separate sheets connected together, or integrally formed by, for example, folding over a sheet to define an edge. The perforation blade 10 forms a line of closely-spaced perforations 30 in each of the bag walls 21 and 22, and defines an easy-open corner portion 32 of the bag 20 removable by hand to form a pourer for dispensing the bag contents.

Figure 3:
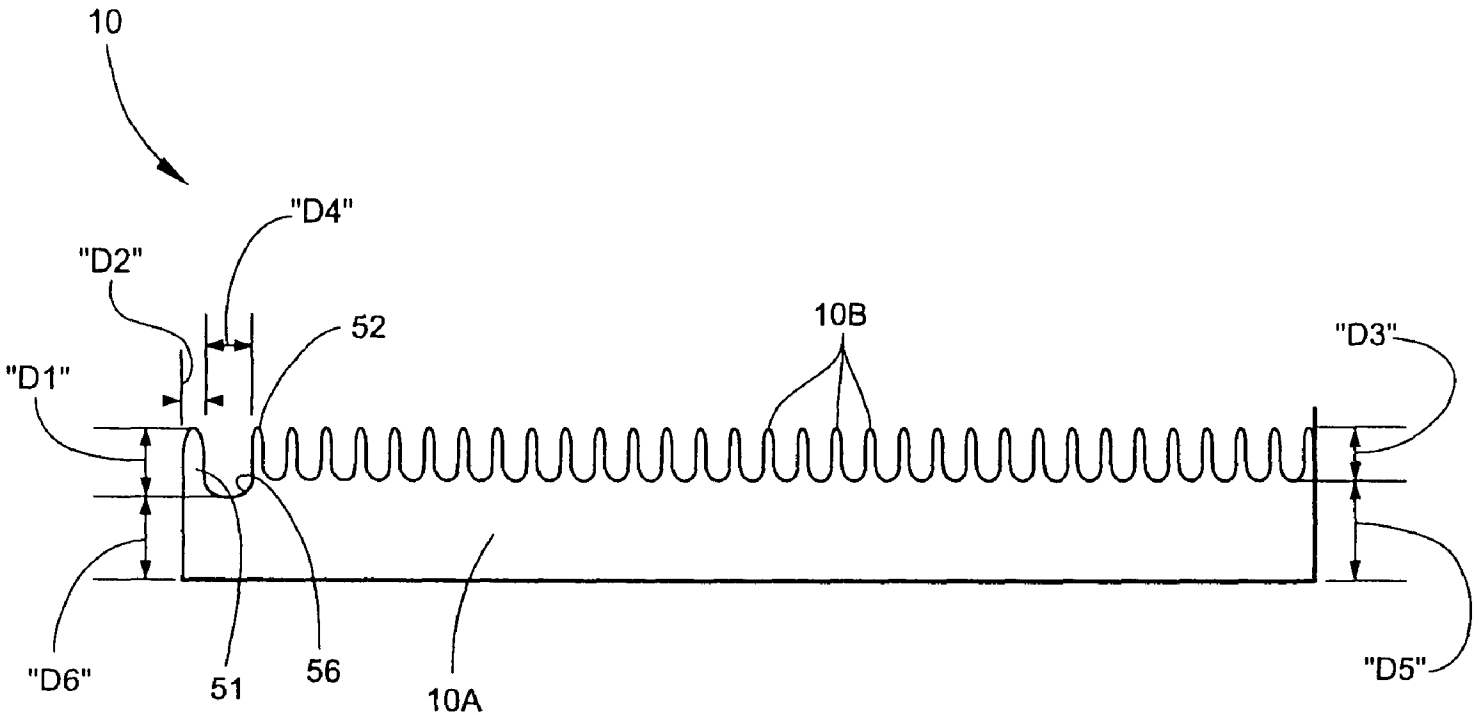
FIG. 3 is view of the perforation blade stretched-out and laid flat.

Referring to FIGS. 1 and 3, the blade 10 is carried in a bag cutting device 40, and is removably attached to an upper block 41 of the device using a mounting bracket 42 and threaded screws 43. The screws 43 extend adjacent the top edge of the blade 10 and into complementary-threaded openings 44 formed in the upper block 41. Upon tightening the screws 43, the bracket 42 frictionally engages the base 10A of the blade 10 to secure the blade in position during use. A lower block 45 with a blade-receiving groove 46 is arranged in precise registration below the upper block 41 such that the teeth 10B of the blade 10 are received within the groove 46 as the upper block 41 descends onto the stationary lower block 45 during cutting. The upper block 41 includes bushings 47 to promote sliding movement along guide rods 48. An air cylinder (not shown) controls movement of the upper block 41.

As best shown in FIG. 3, the blade 10 includes an enlarged starter tooth 51 integrally formed with the base 10A and spaced apart from a first one 52 of the perforation teeth 10B. The last of the perforation teeth 10B is formed at the opposite end of the base 10A. Preferably, the teeth 10B are uniformly spaced and are identical in both length and width. When cutting perforations in the bag 20, the starter tooth 51 penetrates the walls 21 and 22 of the bag 20 and forms a starter nick 54 in the skirt 55 between the end edge 25 and seal line 28. Simultaneously, the perforation teeth 10B penetrate the bag walls 21 and 22 and form the perforated tear line 30 extending from the seal line 28 to the near side edge 23 of the bag 20. The distance between the starter tooth 51 and first perforation tooth 52 defines a relatively deep, burst protection gap 56. The gap 56 is formed to safely receive the seal line 28 of the bag 20 during cutting to prevent the seal line 28 from being severed or otherwise damaged, thereby reducing the likelihood of the bag 20 bursting during shipping and handling. Preferably, the burst protection gap 56 is approximately 20–25 percent deeper than the space 58 formed between adjacent perforation teeth 10B.

According to one embodiment, the length "D1" of the starter tooth 51 is 0.732 inches, and the width "D2" is 0.187 inches. The length "D3" of each perforation tooth is 0.516 inches, and the width is 0.098 inches. The width "D4" of the burst protection gap is 0.453 and the depth 0.732 inches. The space formed between adjacent perforation teeth is 0.256 inches and the depth 0.516 inches. The height "D5" of the base is 0.984 inches in the area of the perforation teeth. The height "D6" in the area of the burst protection gap is 0.768 inches.

Figure 2:
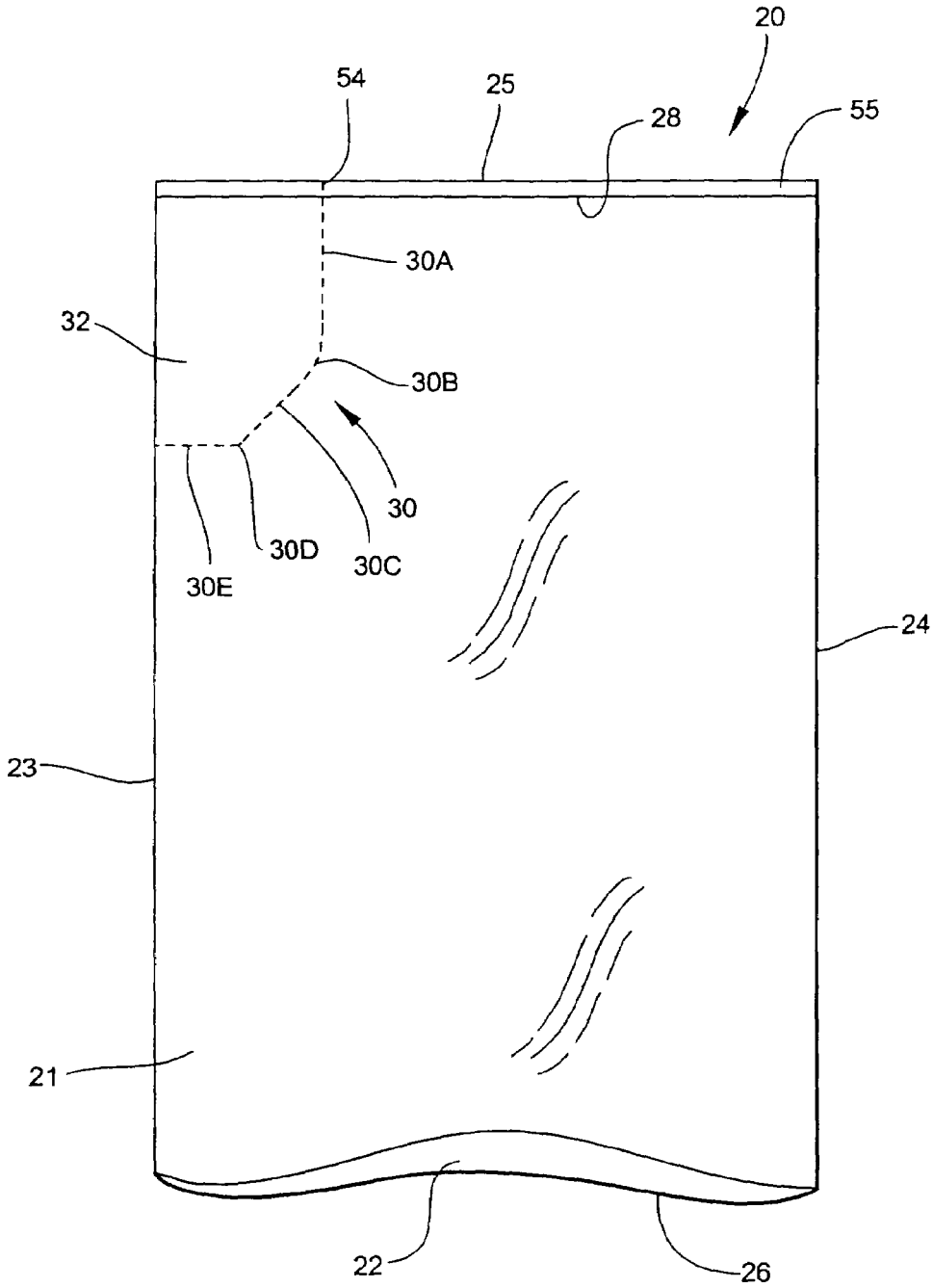
FIG. 2 is a view of the bag after cutting to form the easy-open perforated corner.
Figure 4:
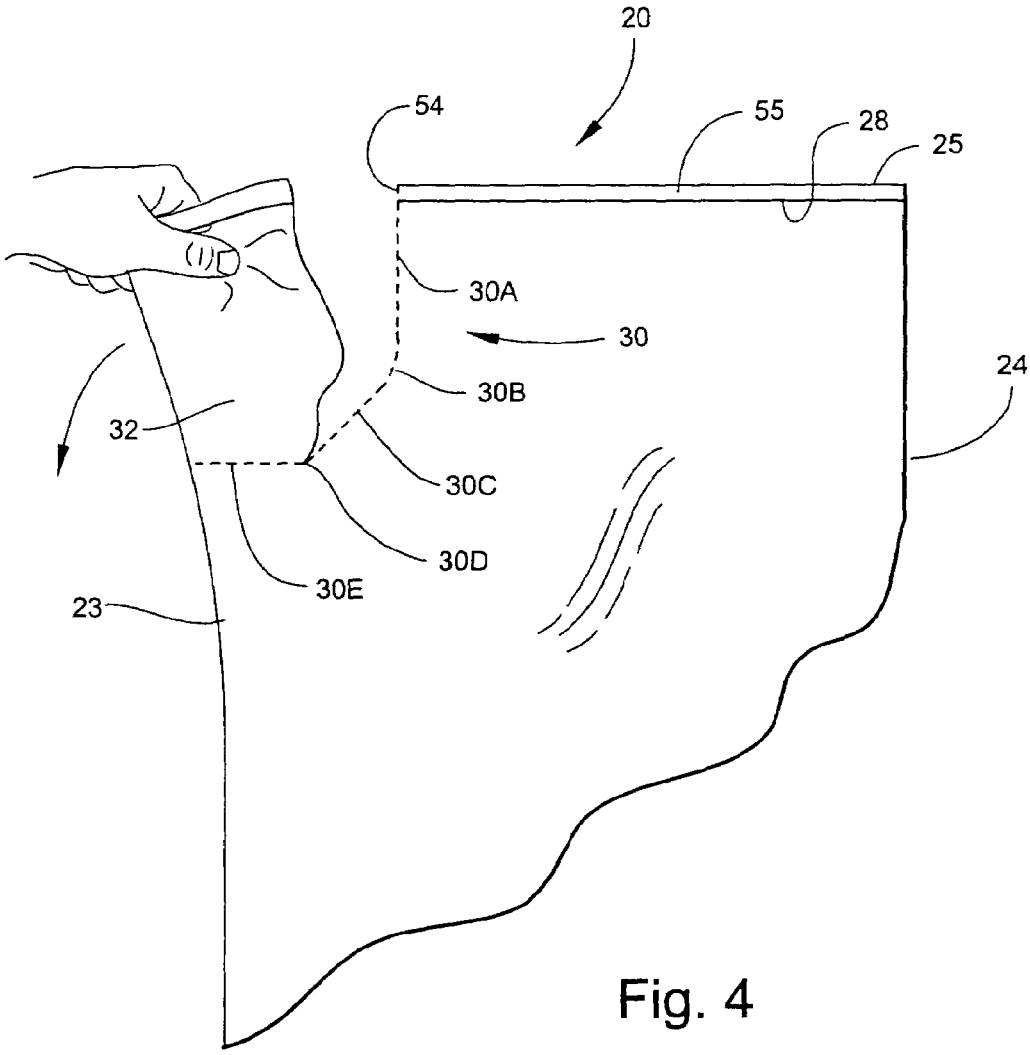
FIG. 4 is a fragmentary view of the bag, and demonstrating the tearing motion used for removing the corner to form a pourer through which the contents of the bag are dispensed.

Referring to FIGS. 2 and 4, in the embodiment shown, the blade 10 is shaped to form a perforated tear line 30 with arcuate transition segments that promote easy opening of the bag at the corner. The tear line includes a vertical segment 30A extending in a straight path downwardly from the top end edge 25 of the bag 20 and generally parallel to the closer side edge 23. A first arcuate transition segment 30B begins at an end of the vertical segment 30A and extends in a generally concave arcuate path towards the closer side edge 23 of the bag 20. The arc radius of this segment is preferably about 1 inch. A diagonal segment 30C is formed along a straight incline from an end of the first arcuate transition segment 30B to a second arcuate transition segment 30D The diagonal segment 30C extends at an angle of 45 degrees relative to the side edge 23. The arc radius of the second transition segment 30D is also about 1 inch. Finally, a relatively short horizontal segment 30E extends from the second arcuate transition segment 30D to the side edge 23 of the bag 20. The overall length of the tear line is 9.8 inches with the first and second arcuate transition segments comprising approximately 16 percent of this length; the length of the vertical segment being 3.9 inches, the first arcuate transition segment being 0.8 inches, the diagonal segment being 3.0 inches, the second arcuate transition segment being 0.8 inches, and the horizontal segment being 1.3 inches. The lateral distance from the side edge of the bag to a top end of the perforated tear line is 4.5 inches. The vertical distance from the top end edge of the bag to the bottom end of the tear line is 7.0 inches.

As shown in FIG. 4, the bag 20 is opened by gripping the top end edge 25 and pulling the bag apart on opposite sides of the tear line 30. A progressive tearing motion readily begins at the starter nick 54 formed on the skirt 55 of the bag 20 and extends along the tear line 30 into the vertical segment 30A causing the lands between the perforations to rupture. The tear extends through the uncut seal line 28 down the vertical segment 30A and then into the first arcuate transition segment 30B. Because of the curved pattern of perforations in the arcuate transition segment 30B, the tear easily transitions into the diagonal segment 30C with relatively little added physical effort, and without deviating from the predetermined path defined by the tear line 30. From the first transition segment 30B, the tear extends at an incline along the diagonal segment 30C to the second arcuate transition segment 30D; and finally, along the short horizontal segment 30E to the side edge 23 of the bag 20. The corner portion 32 is thus completely severed from the bag 20. A pourer is formed in the corner of the bag 20 through which the contents can be dispensed. Contents can be dispensed with complete visibility and without diverting the flow of material, because the bag material severed to form the opening is completely removed and discarded.

A bag with an arcuate-transition tear line is described above. Various details of the invention may be changed without departing from its scope. Furthermore, the foregoing description of the preferred embodiment of the invention and the best mode of practicing the invention are provided for the purpose of illustration only and not for the purpose of limitation—the invention being defined by the claims.

I claim:

1. A method of forming an easy-open corner portion of a bag, the corner portion being removable to define a pourer through which contents of the bag are dispensed, the bag having first and second walls with joined opposing side edges, opposing end edges, and a seal line proximate one of the end edges for sealing closed an end of the bag, said method comprising the steps of:

(a) forming a starter nick in a skirt of the bag between the end edge and the proximate seal line;

(b) forming a series of closely spaced perforations in the first and second walls of the bag, the perforations extending along a predefined tear line from the end edge of the bag proximate the starter nick to one side edge of the bag; and (c) when forming the starter nick and perforations, bypassing the seal line of the bag to avoid damaging the seal line during formation of the easy-open corner portion, such that the seal line protects the bag against inadvertent bursting and spillage of contents, and the tear line intersecting the seal line such that upon removal of the corner portion of the bag along the tear line, the seal line is then severed to allow dispensing of contents through the resulting pourer.

2. A method according to claim 1, and comprising spacing the starter nick from the first of the perforations a distance greater than a distance between the first perforation and a second, adjacent perforation.

3. A method according to claim 1, and comprising spacing the starter nick from the first of the perforations a distance of a least 50 percent greater than a distance between the first perforation and a second, adjacent perforation.

4. A method of forming an easy-open corner portion of a bag, the corner portion being removable to define a pourer through which contents of the bag are dispensed, the bag having first and second walls with joined opposing side edges, opposing end edges, and a seal line proximate one of the end edges for sealing closed an end of the bag, said method comprising the steps of:

(a) forming a starter nick in a skirt of the bag between the end edge and the proximate seal line;

(b) simultaneous with step (a), forming a series of closely spaced perforations in the first and second walls of the bag, the perforations extending along a predefined tear line from the end edge of the bag proximate the starter nick to one side edge of the bag; and (c) when forming the starter nick and perforations, bypassing the seal line of the bag to avoid damaging the seal line during formation of the easy-open corner portion, such that the seal line protects the bag against inadvertent bursting and spillage of contents, and the tear line intersecting the seal line such that upon removal of the corner portion of the bag along the tear line, the seal line is then severed to allow dispensing of contents through the resulting pourer.

5. A method according to claim 4, and comprising spacing the starter nick from the first of the perforations a distance greater than a distance between the first perforation and a second, adjacent perforation.

6. A method according to claim 4, and comprising spacing the starter nick from the first of the perforations a distance of a least 50 percent greater than a distance between the first perforation and a second, adjacent perforation.

* * * * *